United States Patent [19]

Spielman

[11] 4,437,415

[45] Mar. 20, 1984

[54] BURNER BLOCK ASSEMBLY FOR INDUSTRIAL FURNACES

[75] Inventor: Lyle S. Spielman, Rockford, Ill.

[73] Assignee: Eclipse, Inc., Rockford, Ill.

[21] Appl. No.: 402,758

[22] Filed: Jul. 28, 1982

[51] Int. Cl.[3] ..... F23L 5/00

[52] U.S. Cl. ..... 110/182.5; 110/180; 122/6.6; 266/270; 431/160

[58] Field of Search ..... 110/180, 182.5; 431/160; 122/6.6; 266/270

[56] References Cited

U.S. PATENT DOCUMENTS

| | | | |
|---|---|---|---|
| 1,727,337 | 9/1929 | Crawford | 122/6.6 |
| 3,100,461 | 8/1963 | Werner | 431/160 X |
| 3,186,471 | 6/1965 | Costenbader et al. | 122/6.6 X |
| 3,766,868 | 10/1973 | Mahr | 122/6.6 X |

OTHER PUBLICATIONS

Eclipse, Inc. Brochure Entitled "Installation Suggestions and Material Selection Guide for Combustion Blocks and Block Holders" published Apr. 1980.

*Primary Examiner*—Edward G. Favors

*Attorney, Agent, or Firm*—Leydig, Voit, Osann, Mayer & Holt, Ltd.

[57] ABSTRACT

A burner block for an industrial furnace is resiliently seated in a hollow annular member, the latter being made of a metal such as stainless steel and the burner block being made of a refractory material. Because of the resilient mounting, the burner block is seated firmly in the annular member even though these two parts have different rates of thermal expansion. In addition, a cooling fluid is circulated within the interior of the annular member to cool the latter so that the furnace may operate at a temperature which is well above the temperature at which the annular member loses its structural integrity. All of this permits the burner block assembly to be mounted effectively on the metal outer shell of the furnace without relying upon the refractory lining of the furnace for support.

4 Claims, 2 Drawing Figures

BURNER BLOCK ASSEMBLY FOR INDUSTRIAL FURNACES

BACKGROUND OF THE INVENTION

This invention relates to an industrial furnace where the burner is supported by a burner block mounted in a wall of the furnace. Such walls have been either hard wall or soft wall. In either case, the furnace includes a metal shell but, in the case of a hard wall furnace, the shell is lined with insulating brick and hard brick, both made of a refractory material, while the lining for a soft wall construction includes a refractory blanket which may be used alone with the shell or may replace the hard brick and used with the shell and the insulating brick.

Soft shell linings have the advantage of better insulating characteristics but the nature of the blanket used in soft wall linings provides very little support for the burner block. If the burner block is mounted in the side wall of a furnace using a hard wall lining, the lining basically will support the burner block but, even with a hard wall lining, the burner block is not supported well if it is mounted on the top wall of the furnace.

Ideally, these difficulties could be overcome if the burner block assembly were mounted on the furnace shell. This, however, has not been practical for a number of reasons. The main reason for these difficulties is that the burner block is made of a refractory material and its support or holder is made of a metal such as stainless steel. These two materials have quite different ratios of thermal expansion so that the heat of the furnace destroys the integrity of the burner block assembly. Moreover, the metal of the holder becomes ineffective as a support at temperatures well below the desired operating temperatures of the furnace.

SUMMARY OF THE INVENTION

The general object of the present invention is to overcome the difficulties set forth above by providing a novel burner block assembly where the connection between the block and its metallic support are not affected by the different ratios of thermal expansion and, in addition, the metal support for the block does not lose its supporting integrity when the furnace is operated at the desired temperatures whereby the assembly may be firmly supported by the furnace shell without relying upon the refractory lining for support.

A more detailed object is to achieve the foregoing by making the metallic support for the burner block as a hollow annulus through which a cooling fluid flows to keep the annulus at a temperature below the operating temperature of the furnace and at a temperature where the annulus maintains its structural integrity and to mount the block resiliently on the annulus so that the different ratios of thermal expansion have no effect upon the cooperation of the block and the annulus.

Other objects reside in the specific construction and arrangement of the parts of the burner block assembly.

DETAILED DESCRIPTION OF THE PREFERRED EMBODIMENT

Figure 1:
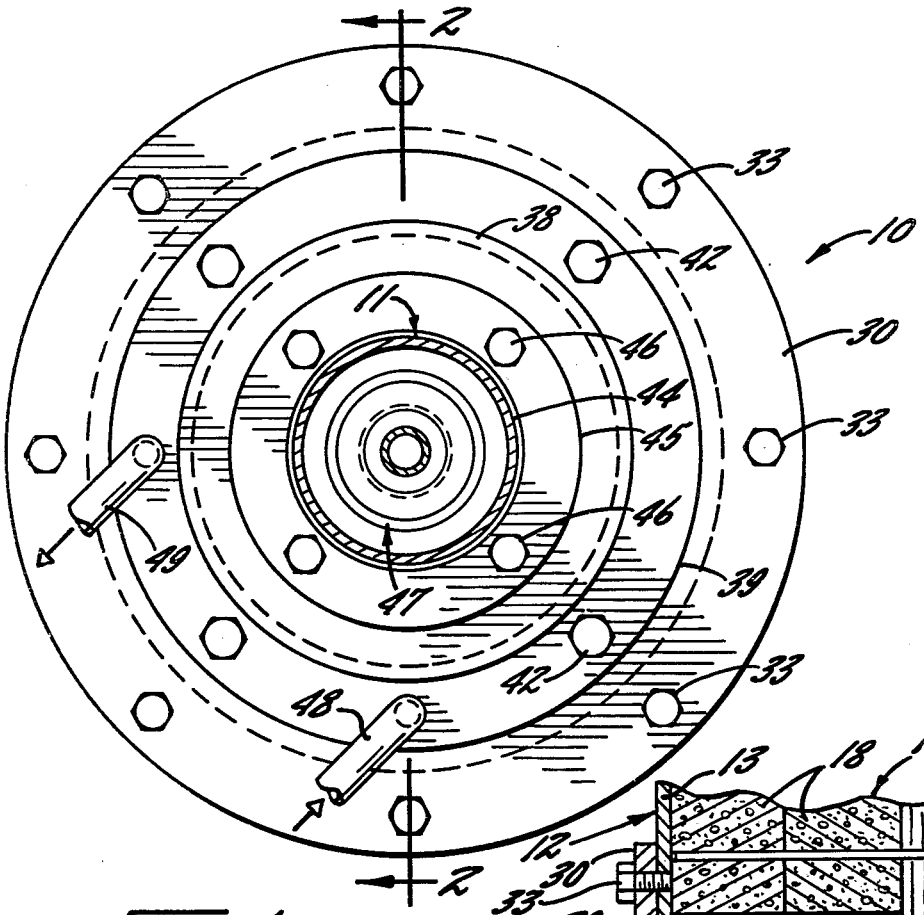
FIG. 1 is a front elevational view of a burner block assembly incorporating the novel features of the present invention.
Figure 2:
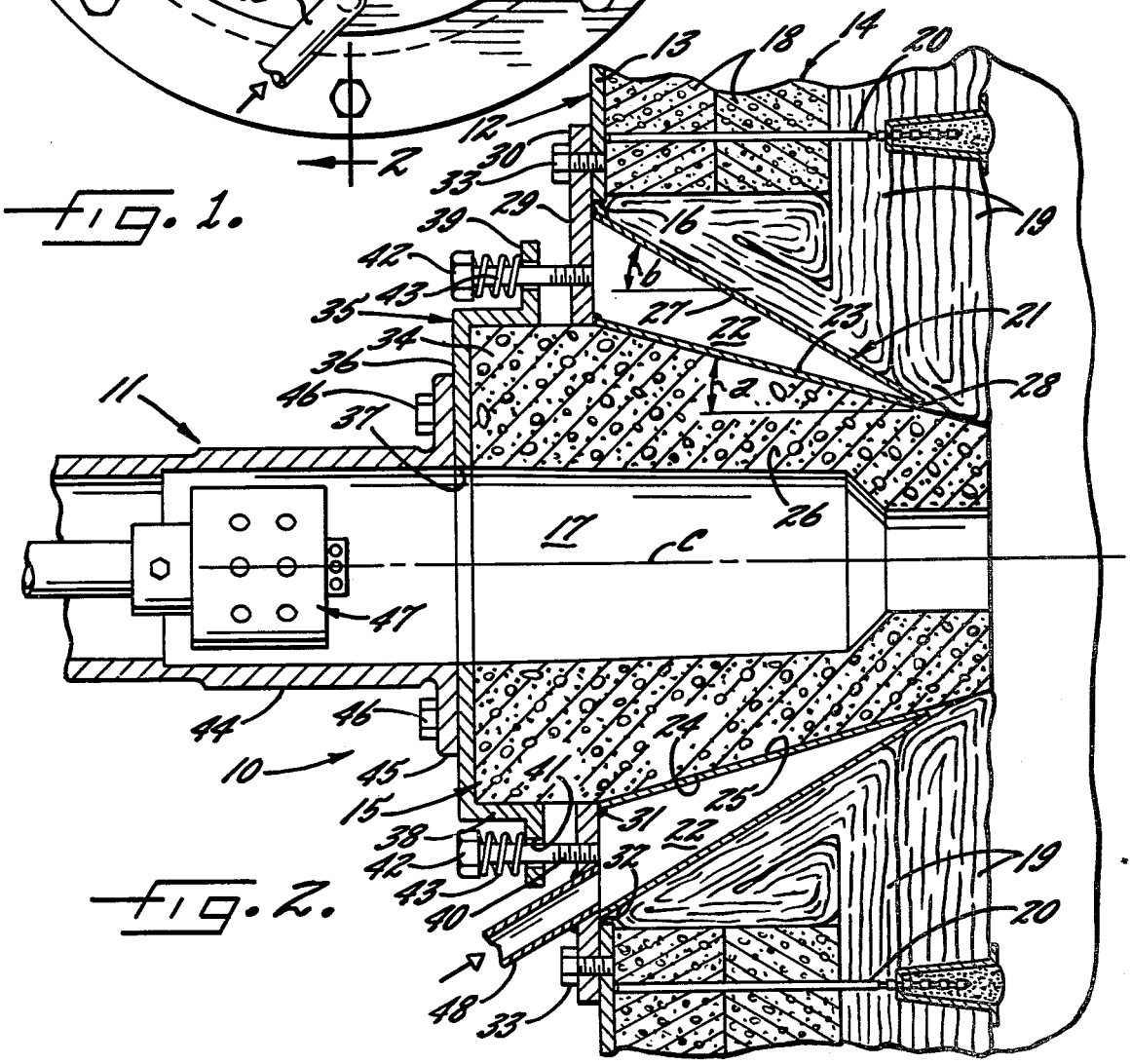
FIG. 2 is a sectional view taken along the line 2—2 in FIG. 1 and showing the assembly mounted on a furnace with a soft wall lining.

As shown in the drawings for purposes of illustration, the invention is embodied in a burner block assembly 10 for supporting a burner 11 in a wall 12 of an industrial furnace such as a kiln. Although the assembly may be mounted on the top wall of the furnace, it is shown herein as mounted in a vertical wall and the wall includes a shell 13 made of metal such as steel and a lining 14 of refractory material disposed along the inner side of the shell. The assembly 10 includes a burner block 15 of refractory material projecting through a hole 16 in the shell and through the lining 14. The burner 11 is alined with a central opening or tunnel 17 in the burner block and a mixture of a combustible gas and air is delivered through the burner and burns in the tunnel to heat the interior of the furnace.

Industrial furnaces of this nature utilize various types of linings 14. One is known as a hard wall and basically is built up with insulating bricks 18 immediately behind the shell 13 and hard bricks (not shown) behind the insulating bricks. Soft wall installations utilize blankets of ceramic fiber material and, in some instances, the blankets are used alone while, in other cases, as in the illustrated form, the blankets 19 are used with insulating brick and tied to the latter by pins 20. Soft walls are more desirable than hard walls because of their better insulating characteristics. With all of these types of wall construction, however, there has been difficulty in mounting a burner block so that it has a reasonably long service life and this has been particularly true in those cases where the block is mounted in the top wall of the furnace and even more so when used with a soft wall construction regardless of where the block is mounted. Various attempts have been made to overcome this difficulty. One has been to mount the burner block by stainless steel "J" bolts, portions of which are cast in the block. Another is to cast the block in a stainless steel shell which is anchored to the refractory material. Neither of these arrangements, however, has been outstandingly successful due to such factors as uneven rates of thermal expansion and lack of support by the lining 14 in soft wall installations.

To overcome the foregoing difficulties, the present invention contemplates the provision of a novel burner block assembly 10 by which the block 15 is firmly supported by the shell 13, which maintains the support even when the furnace is operating at temperatures above 2000 degrees Fahrenheit and which automatically compensates for uneven rates of thermal expansion. In general, this is achieved by employing a hollow annular metal member 21 which is mounted on the furnace shell 13 and which defines a cooling chamber 22 for the flow of a cooling fluid and by mounting the burner block 15 on the member 21 and resiliently urging the block against the inner wall 23 of the latter. As a result, the lining 14 does not have to perform any supporting function. At the same time, the member 21 is kept cooled below the temperature at which it loses strength even though the furnace is operating at a considerably higher temperature. Moreover, because the block 15 is resiliently held against the wall 23, there is a firm engagement between the two even though the block and the member 21 have different rates of thermal expansion.

The burner block 15 has an inwardly facing surface 24 which is seated on an outwardly facing surfact 25 on the inner wall 23 of the annular member 21 and those surfaces extend completely around both the burner block and the annular member. Herein, the inner wall is tapered at an angle a from the end adjacent the furnace shell 13 inwardly through the lining 14 and the inner end portion 26 of the burner block 15 is conical to form the surface 24 with the angle a also being a cone angle of this portion. More specifically, the inner wall 23 is a ring of stainless steel and the annular member 21 also includes an outer ring 27 tapered inwardly at an angle b which is larger than the angle a so that the outer edges of the rings, that is, the edges flush with the shell 13, are spaced apart while the inner edges meet and are welded together around their entire circumferences as indicated at 28. The member 21 is completed by an annular flange 29 which is disposed transversely of the axis c of the member and which extends radially beyond the outer ring 27 to provide a peripheral portion 30 which overlaps the furnace shell 13. The flange is welded to the outer edges of the rings as indicated at 31 and 32 so that these three parts are rigidly fastened together and define the annular cooling chamber 22. Bolts 33 passing through the peripheral portion 30 of the flange 29 are threaded into the furnace shell 13 and thus, as will become more apparent, the shell becomes the entire support for the assembly 10. Preferably, the flange 29 also spans the outer edges of the rings 23 and 27 to close the outer end of the annular member 21.

To support the burner block 15 resiliently on the annular member 21, the outer end portion 34 of the block herein is cylindrical and projects slidably through the flange 29. Bonded to the end of the cylindrical portion by a suitable refractory cement is a metal cup 35 with its end wall 36 against the outer end of the block and formed with a central hole 37 alined with the tunnel 17. The cylindrical side wall 38 of the cup 35 fits snugly around the outer end portion 34 of the block 15 and a flange 39 integral with the side wall projects radially outwardly therefrom. A plurality of bolts 40, herein four, project loosely through holes 41 formed in and angularly spaced around the flange 39. One end of each bolt is threaded into the flange 29 and a head 42 is formed on the other end of the bolt and is spaced outwardly of the flange 39. Coiled compression springs 43 encircle the bolts and act between the heads 42 and the flange 39. The size of the tapered portion 26 of the burner block is such that the flanges 29 and 39 are spaced apart and thus the springs 43, acting through the cup 35, urge the tapered portion firmly against the inner ring 23 of the member 21. Because of this resilient mounting, the sizes of the block 15 and the member 21 may change at different rates due to thermal expansion but the conical portion 26 of the block remains firmly seated in the inner ring 23 of the member 21.

The cup 35 also serves as the mounting for the burner 11 and, to this end, the burner body 44, which is in the form of a tube, includes a radial flange 45 at its inner end with the flange disposed against the end wall 36 of the cup. The tube is axially alined with the tunnel 17 and the flange 45 is secured to the end wall 36 by bolts 46. The burner tip 47 and its associated parts are mounted in the tube 44 in the conventional manner.

A cooling fluid is circulated through the cooling chamber 22 and carries away heat which has been transferred to the annular member 21 by the burner block 15, the lining 14 and other parts of the furnace. In this way, the member 21 is maintained at a temperature substantially below the operating temperature of the furnace and within the temperature range of the structural integrity of the member 21. Preferably, the cooling fluid is air and, to circulate it through the chamber 22, the latter includes at least one inlet port 48 and one outlet port 49 although more than one of each may be employed. In the preferred embodiment, there is one of each and the inlet port is a tube projecting through and welded to the flange 29 and the outlet also is a tube similarly associated with the flange 29. Each of the tubes is disposed at about a 45 degree angle to the axis c and is directed at an angle which is generally tangential to the inner ring 23 of the annular member 21 so that the air is directed tangentially and toward the inner or narrow end of cooling chamber. This causes the air in the chamber to rotate with a whirlpool effect so that the air scrubs the rings 23 and 27 and removes heat from the latter, the hot air being exhausted through the outlet port 49. Thus, the metal of the annular chamber is maintained at a functional temperature.

It will be seen that the novel construction of the present invention overcomes the major disadvantages of prior arrangements. This essentially results from an effective manner of mounting the burner block assembly 10 on the furnace shell 13 without relying upon the refractory lining 14 for support. For example, the assembly 10 is held firmly from the roof or top wall of the furnace whether the hard or soft lining is used. The cooling chamber 22 maintains the structural integrity of the annular member 21 at a temperature which is appreciably lower than the operating temperature of the furnace. Further, the resilient mounting of the burner block 15 on the annular member 21 results in a good seating between the two irrespective of different rates of thermal expansion.

I claim:

1. For use with a furnace having a metal shell and a refractory lining on the inner side of the shell, a burner block assembly having, in combination, a hollow annular member closed at both ends to define an annular cooling chamber and adapted to project through a hole in the shell and into the lining with one end of the member disposed adjacent the shell, said member having a predetermined rate of thermal expansion and haing an inner wall which defines a central opening with the opening being conical and becoming smaller in cross section from said one end to the other end, said member also including a radial flange overlapping the shell around the entire periphery of the hole and adapted to be attached to the shell, a burner block made of refractory material and having an inner portion projecting into said opening, the cross sectional shape of said inner end portion being conical and complemental to the cross sectional shape of said opening whereby the end portion is seated against said inner wall, said burner block having a rate of thermal expansion significantly different from said predetermined rate, and means mounting said block on said annular member and including resilient means urging said inner end portion axially inwardly and firmly against said inner wall while permitting relative axial movement caused by the different rates of thermal expansion, said annular member having at least one inlet port and at least one outlet port to permit a cooling fluid to be circulated through said chamber thereby to remove heat from said annular member.

2. For use with a furnace having a metal shell and a refractory lining on the inner side of the shell, a burner block assembly having, in combination, a metal annulus adapted to project through a hole in the shell and into the refractory lining and comprising inner and outer rings, said inner ring being tapered at a predetermined angle inwardly from the edge adjacent the shell, said outer ring being similarly tapered but at an angle greater than said predetermined angle whereby the edges of the rings adjacent the shell are spaced apart, the opposite edges of said rings being joined around the entire circumferences of the rings and the rings defining a cooling chamber between them, an annular metal flange rigid with said rings and extending across the spaced edges and radially beyond said outer ring, said flange closing said chamber and providing means for attaching said annulus to the shell, an elongated burner block made of refractory material and having a conical section intermediate its ends, the cone angle of said section being substantially equal to said predetermined angle and said section being seated in said inner ring with the outer end porton of said block projecting outwardly beyond the shell, a metal plate fixed to the outer end of said block and having an outwardly projecting radial flange, a plurality of bolts each having a head and each projecting loosely through said radial flange, and threaded into said annular flange, and a plurality of coiled compression springs, one for each of said bolts and each encircling the shank of the associated bolt, said springs acting between said heads and said radial flange to urge said conical portion of said block firmly against said inner ring, said annular flange having at least one inlet port and at least one outlet port to permit cooling air to be circulated through said chamber thereby to remove heat from said metal annulus.

3. An assembly as defined in claim 2 in which said inlet port is a tube disposed at an angle relative to the axis of said annulus and tangentially to said inner ring to cause the cooling air to fill said cooling chamber and flow around the chamber.

4. An assembly as defined in claim 3 in which said angle is approximately 45 degrees.

* * * * *